United States Patent [19]

Rehkemper et al.

[11] Patent Number: 4,597,744

[45] Date of Patent: Jul. 1, 1986

[54] SELF-PROPELLED TOY

[75] Inventors: Steven F. Rehkemper, Chicago; Harry Disko, South Barrington, both of Ill.

[73] Assignee: Marvin Glass & Associates, Chicago, Ill.

[21] Appl. No.: 579,144

[22] Filed: Feb. 10, 1984

[51] Int. Cl.[4] ..... A63H 11/12; A63H 5/00; A63H 17/16; A63H 17/25

[52] U.S. Cl. ..... 446/278; 446/275; 446/291; 446/414; 446/440

[58] Field of Search ..... 446/251, 275, 279, 289, 446/290, 291, 292, 293, 376, 273, 274, 276, 277, 278, 420, 437, 440, 441, 442, 461, 462, 463, 469, 470, 471, 487, 489, 490, 491; 74/125.5, 126, 132

[56] References Cited

U.S. PATENT DOCUMENTS

| | | | |
|---|---|---|---|
| 722,914 | 3/1903 | Schneider | 74/125.5 |
| 1,619,694 | 3/1927 | Berger | 446/275 |
| 2,232,615 | 2/1941 | Kupka | 446/278 |
| 2,578,682 | 12/1951 | Fernstrom | 446/279 X |
| 2,596,216 | 5/1952 | Dawson | 446/278 |
| 2,750,934 | 6/1956 | May | 74/132 |
| 3,181,270 | 5/1965 | Trevena | 446/278 |
| 3,765,693 | 10/1973 | Morrison et al. | 446/290 X |
| 4,143,484 | 3/1979 | Yonezawa | 446/278 |
| 4,186,516 | 2/1980 | Ensmann | 446/279 X |
| 4,438,589 | 3/1984 | Matsushiro | 446/462 |

*Primary Examiner*—Robert A. Hafer
*Assistant Examiner*—D. Neal Muir
*Attorney, Agent, or Firm*—John S. Pacocha

[57] ABSTRACT

A battery motor driven toy has articulated front and rear sections that are extended and contracted about a horizontal pivot in a scissor-like action. Each of the sections carries a surface engaging wheel mounted for rotation only in the forward direction. A biasing force pulls the sections together while the motor drives the sections apart against the biasing force through a gear train that includes gear segments on each section. When the front section is driven, the rear section remains stationary but is pulled forward by the biasing force at the end of the drive cycle while the front remains stationary. Placement of the motor and other weight over the rear wheels results in the vehicle doing a "wheelie" when forward movement of the rear wheels is obstructed so that the front section rises up above the play surface while continuing to extend and retract in a snapping-like action. A counterweighted sound device is mounted under the rear section so that it is activated when the vehicle does a "wheelie".

20 Claims, 7 Drawing Figures

Fig 1
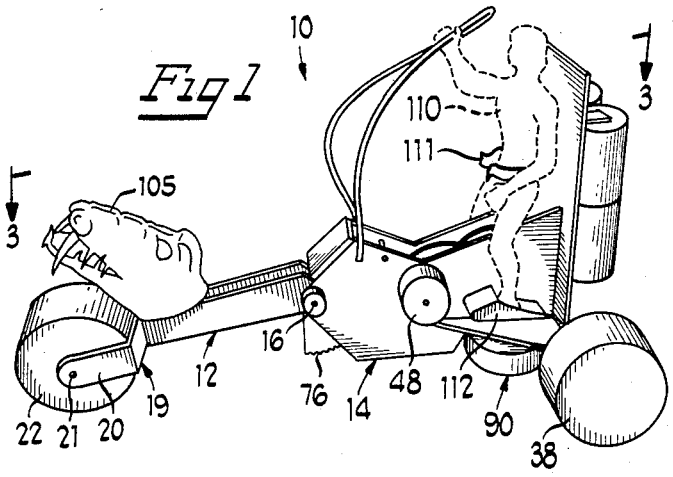
Fig 2
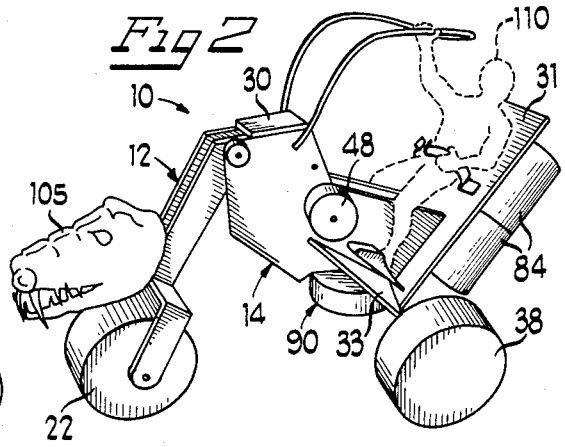
Fig 3
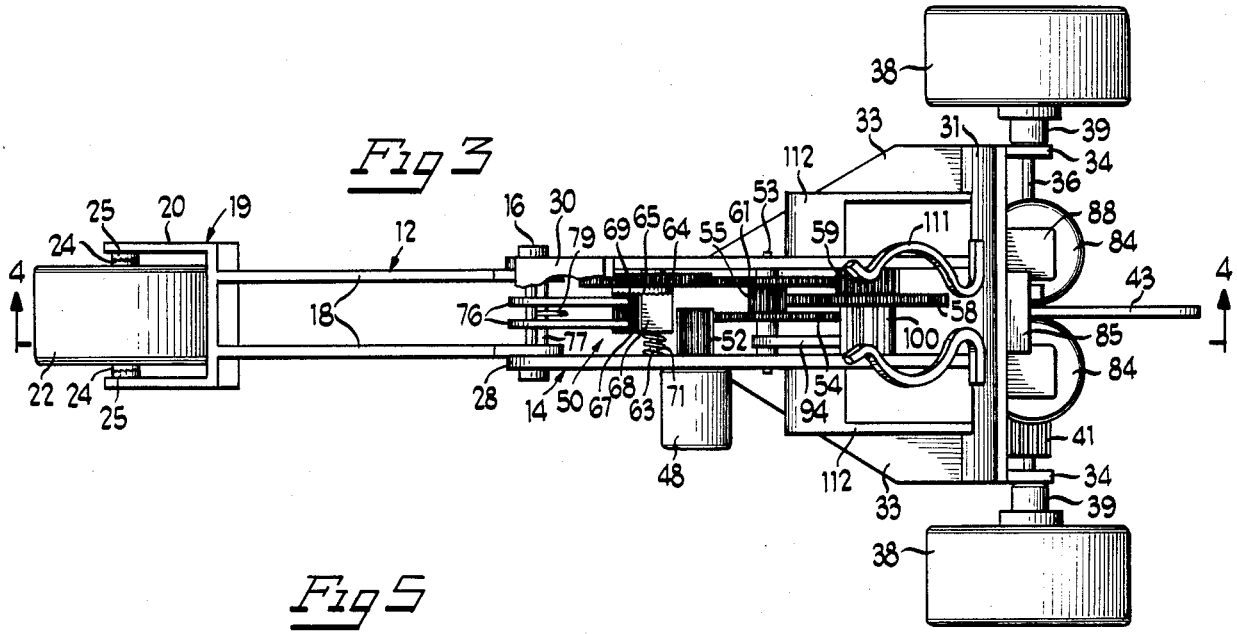
Fig 5
Fig 4
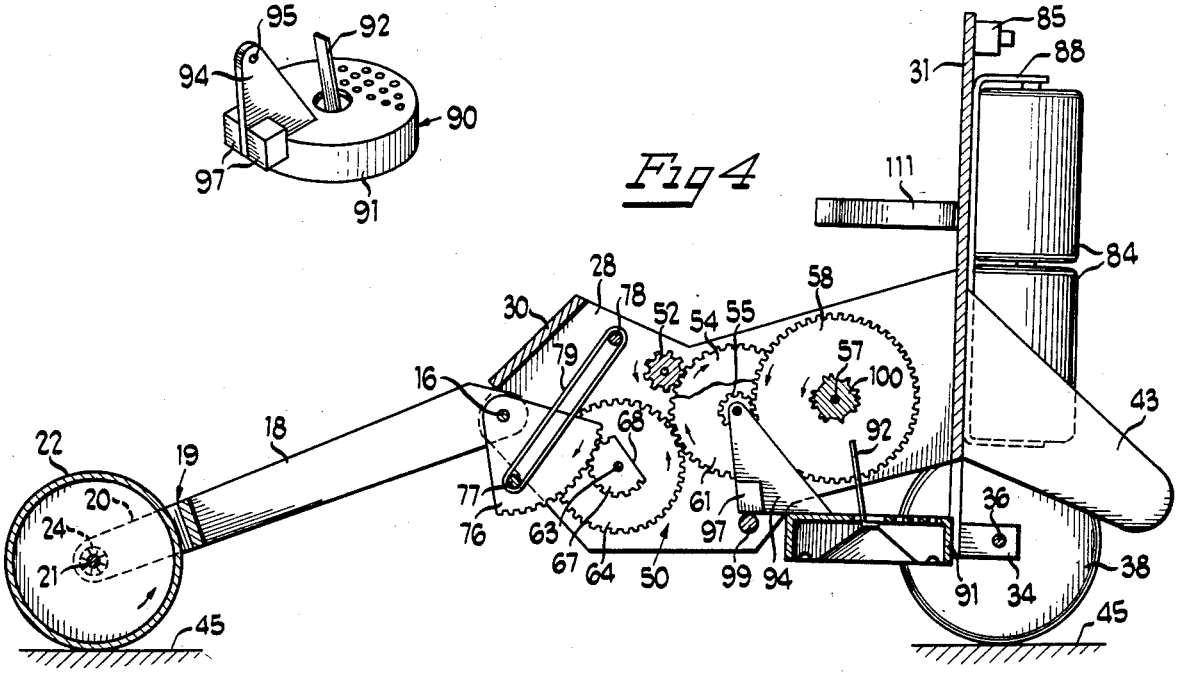

SELF-PROPELLED TOY

BACKGROUND OF THE INVENTION

1. Field of the Invention

This invention relates generally to self-propelled toys and, more particularly, to toys having a fantasy form of locomotion.

2. Background Art

Self-propelled toys such as vehicles and, more particularly, toys that are propelled over the playing surface in a fantasy form of locomotion have been popular toys. Examples of such fantasy forms of locomotion in prior art toys are disclosed in U.S. Pat. Nos. 2,827,735; 3,609,804; 4,333,259; and 4,380,135. In these prior art toys the locomotion is accomplished by the movement of leg or wheel like members while the body remains relatively static. U.S. Pat. No. 4,143,484 discloses a self-propelled toy with a more conventional drive mechanism but including an actuator to intermittently pivot articulated members of the toy to simulate an arching or undulating motion. There remains a need for additional self-propelled toys having a different fantasy form of locomotion in which the articulated body of the toy is periodically pivoted to provide a prehensile or clawing type of movement.

SUMMARY OF THE INVENTION

The present invention is concerned with providing a self-propelled toy with an effective and entertaining fantasy form of locomotion. These and other objects and advantages of the invention are achieved by articulated front and rear sections that are extended and contracted about a horizontal pivot in a scissor-like action. A surface engaging wheel whose rotation is restricted to the forward direction is mounted about an axis on the free end of each section that is parallel to the pivot axis. The sections are pulled together by a biasing force while a motor periodically drives the sections apart against the biasing force through a gear train that includes gear segments on each section. Extending the sections increases the spacing between the wheel axes, causing the front wheel to rotate in the forward direction while the rear wheel remains stationary. Upon disengagement of the gear segments, the biasing force contracts the sections decreasing the spacing between the wheel axes and causing the rear wheel to rotate forward while the front wheel remains stationary. The motor and batteries supplying power to the motor are mounted over the rear wheel axis so that when the forward movement of the rear wheel is obstructed, the front section rises up above the play surface while continuing to periodically extend and retract in a snapping-like action. A counterweighted sound device mounted under the rear section pivots into engagement with the gear train to generate sound when the vehicle does a "wheelie". The toy may be in the form of a creature having a head on the front section and may also provide for securing a toy figure rider.

BRIEF DESCRIPTION OF THE DRAWINGS

For a better understanding of the present invention reference may be had to the accompanying drawings in which:

FIG. 1 is a perspective view of an embodiment of the present invention in the lowered or extended position;

FIG. 2 is a perspective view in the raised or contracted position;

FIG. 3 is an enlarged scale, section view taken generally along the line 3—3 of FIG. 1;

FIG. 4 is a sectional view taken generally along the line 4—4 of FIG. 3;

FIG. 5 is an enlarged scale, perspective view of the sound device;

DETAILED DESCRIPTION OF THE PREFERRED EMBODIMENT

Figure 6:
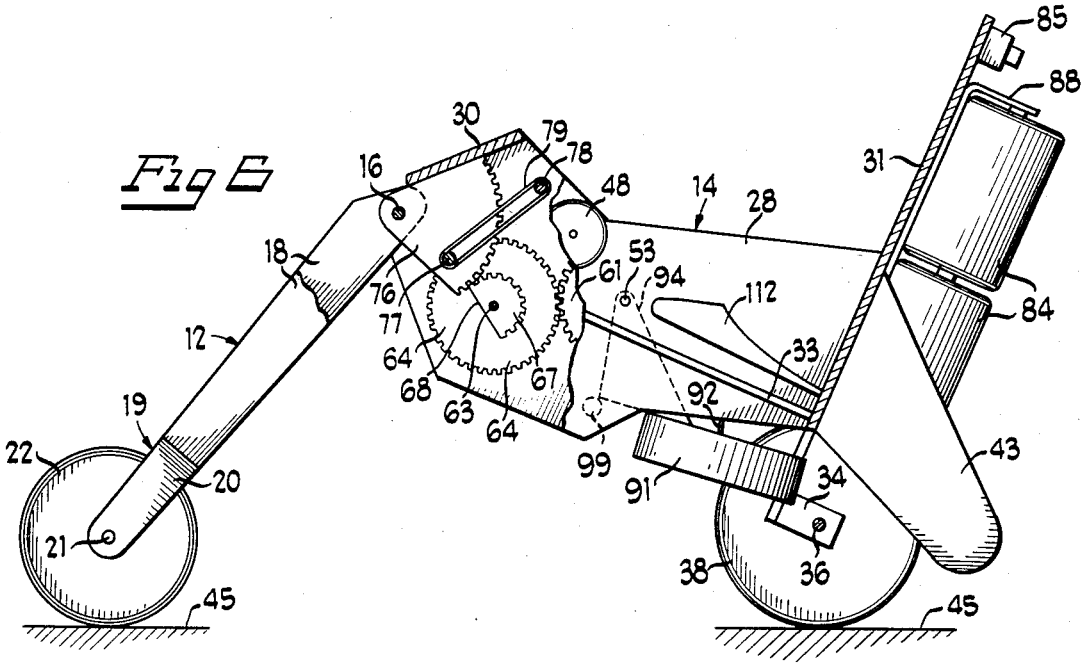
FIG. 6 is a side elevational view, partially broken away and partially in section, showing the sections beginning to lower or expand.

Referring now to the drawings in which like parts are designated by like reference characters throughout the several views, there is shown in FIG. 1 a self-propelled toy 10 with a body having articulated front and rear sections 12 and 14, respectively. The two sections are connected to each other at one end by a pin or bolt 16 forming an axis about which the sections are pivoted for expanding and contracting the free ends.

Front section 12 has a pair of spaced apart, substantially parallel, elongated members 18 which are connected at one end by the pin 16 to the rear section 14. The other end of each of the elongated members 18 is attached to, or may be integrally formed as part of, a fork 19. Extending between the open tines 20 of the fork is a transverse axle 21. Front wheel 22 is mounted for rotation relative to the section 12 around an axis coincident to the center of the axle 21.

Wheel 22 may either be mounted for rotation around the axle, or together with the axle may be journaled for rotation in the fork 19. Section 12, more particularly fork 19, is made of plastic or metal so as to be sufficiently resilient to exert some axially compressive force along the axle 21. In addition, it is preferred that the front wheel 22 be a relatively thin walled, hollow, air filled shell made of resilient material such that a downward force exerted on the axle 21 will expand the side walls of the wheel 22 producing a resultant outward axial bias along the axle.

Front wheel 22 is restricted to rotation in a forward direction by means of face ratchets 24 and 25. Inner face ratchet 24 is mounted for rotation with the wheel 22 or axle 21 while outer face ratchet 25 is fastened against movement to the inside of a tine 20. The facing ratchet teeth are oriented to permit the wheel 22 to rotate forwardly or counterclockwise as the wheel is shown in FIGS. 1, 2, 4, 6 and 7. Fork 19 tending to compress the ratchets together, or the resultant axial force exerted by the air filled wheel 22, will engage the face ratchets to prevent rearward, or clockwise rotation of the wheel 22 while permitting forward rotation. As shown in FIG. 3, there is a set of face ratchets 24 and 25 on either side of the wheel 22. However, a suitable spacer (not shown) could be substituted for one of the ratchet sets.

Rear section 14 includes spaced apart, substantially parallel, side walls 28 spanned at one end by a cap 30 and at the other end by a tail plate 31. In the embodiment shown, the tail plate is substantially wider than the span between the side walls 28. Accordingly, strengthening webs 33 lying in a plane transverse to both the side wall 28 and the tail plate 31 are attached from approximately the middle of the side wall 28 to the tail plate 31. Extending rearwardly from adjacent the bottom on each side of the tail plate 31 is an axle support 34.

Figure 7:
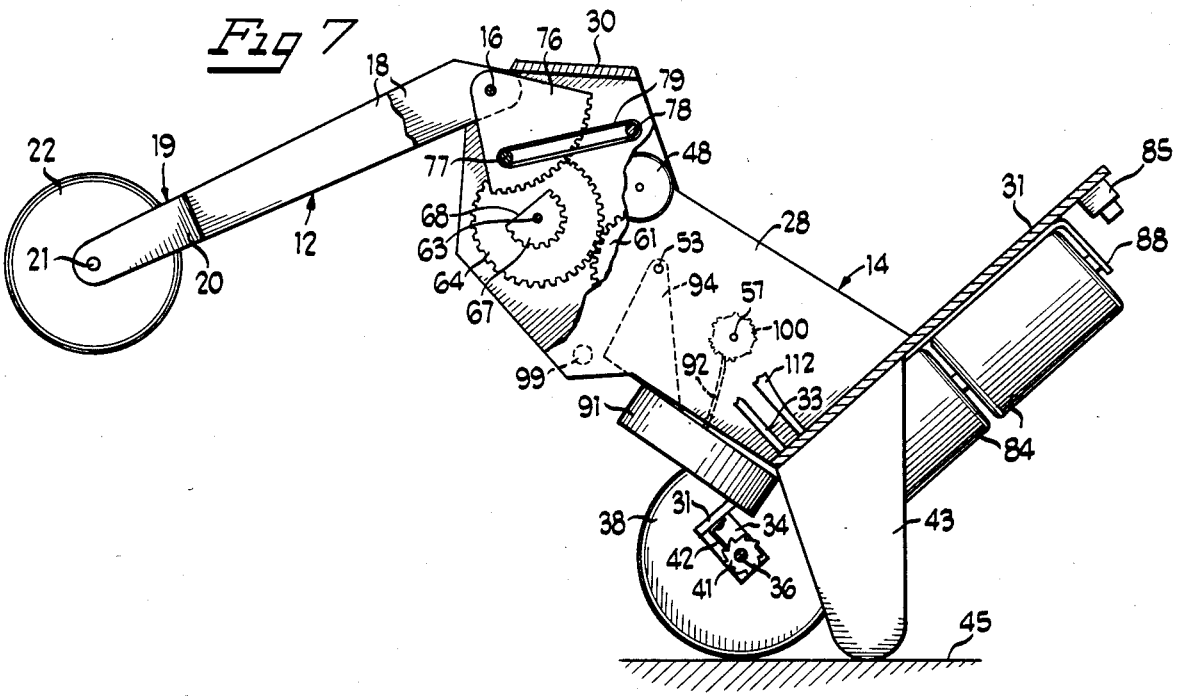
FIG. 7 is a side elevational view, partially broken away and partially in section, showing a "wheelie".

Journaled between the axle supports 34 and extending out beyond each of the axle supports is an axle 36. Attached to each outwardly extending end of the axle for rotation with the axle 36 is a rear wheel 38 having an inwardly projecting integral hub 39. Also secured to the axle 36 for rotation with the axle is a ratchet gear 41. As is shown in FIG. 7, a stationary pawl 42 is secured to the tail plate 31 for engagement with the ratchet gear 41. The teeth of the ratchet gear are oriented to prevent rearward or clockwise rotation of the wheel 38. Extending rearwardly and downwardly from the tail plate 31 is an angled skid 43.

Adjacent the cap plate 30, the side walls 28 are connected to the members 18 of the front section by the pin 16 for pivoting about the axis of the pin. The axis of the front wheel 22, the pivot axis through the pin 16, and the axis of the rear wheels 38 are all parallel, with the pivot axis being intermediate the wheel axes. Thus, when the front and rear sections are extended, lowering the respective free ends connected by the pin 16, the distance between the wheel axes is increased. On the other hand, when the front and rear sections are contracted or pulled together, raising the connected ends of each of the sections, the distance between the wheel axes is decreased.

During extension of the front and rear sections the rear wheels 38 being ratcheted against rearward or clockwise rotation remain stationary while the front wheel 22 rotates in a forward or counterclockwise direction. When the sections are pulled together, the front wheel is prevented from rearward or clockwise rotation by the engagement of the face ratchets 24 and 25, causing the rear wheels 38 to rotate forwardly in a counterclockwise direction. Thus, by alternate extension and contraction of the sections forming the articulated body of the toy, the toy will be advanced across a playing surface 45 in a prehensile or clawing manner.

Motor 48 is mounted on the outside of one of the side walls 28 driving a gear train 50 that is substantially housed within the rear section 14. Directly connected to the output shaft of the motor 48 is a motor pinion 52. Mounted for rotation on a shaft 53 that is supported between the spaced side walls 28 is a spur gear 54 that is driven by the motor pinion 52. Keyed for rotation with the spur gear, or integrally formed with the spur gear 54, is a stepped down coaxial pinion gear 55. On another shaft 57 extending between the side walls 28 and substantially parallel to the shaft 53, there is a coaxial keyed, or integrally formed, gear set comprising spur gear 58 and pinion 59. Spur gear 58 is driven by pinion 55 and the pinion 59 rotating with spur gear 58 drivingly engages a gear 61 rotating on shaft 53. A third shaft 63 supported between the side walls 28 and also parallel to shafts 53 and 57 carries a gear 64 that is driven by the gear 61. As illustrated by the arrows in FIG. 4, the motor pinion 52 is driven in a counterclockwise direction effecting clockwise rotation of the spur 54 and pinion 55, with spur 58 and pinion 59 then being driven in a counterclockwise rotation to drive spur 61 clockwise, which then drives spur 64 and gear segment 67 counterclockwise.

Attached to, or integrally formed with, the gear 64 is a face ratchet 65. Also carried for rotation on the shaft 63 is a gear segment 67 which has a toothless chordal portion 68 and a face ratchet 69 on one end. Face ratchets 65 and 69 have relatively fine small teeth, as compared to the other teeth in the gear train 50. Coaxial coil compression spring 71 biases face ratchets 65 and 69 into engagement as a clutch to normally transmit rotation. However, should a child exert a downward force atop the pivotal connection forcing the pin 16 downwardly and expanding the free ends of the sections 12 and 14, the spring 71 will permit the relatively fine teeth of the face ratchets 65 and 69 to disengage, protecting the rest of the gear train and the motor.

A pair of spaced sector gears 76 are mounted on the pin 16 for movement together with the front section 12. The rear section 14 pivots freely about the pin 16. As shown in FIG. 3, the gear segments 76 may be secured or keyed to the pin 16 along with the ends of the elongated members 18. Alternatively, the gear segments 76 may be attached to the members 18 directly or by means of a spacer block (not shown) or may even be integrally formed as a part of the front section 12. Extending between the spaced gear segments 76 is a bar 77; a parallel bar 78 extends between the side walls 28 of the rear section 14. Attached, in tension, between the bars 77 and 78 is a rubberband 79. A spring or other biasing force could be substituted for rubberband 79. The bias of the rubberband 79 pulls the sections 12 and 14 together about the pivot axis of the pin 16.

As shown in FIG. 4, when the front section 12 and the rear section 14 are driven apart by the engagement of the teeth on the gear segments 67 and 76, the rubberband 79 is further stretched, increasing the biasing force that pulls the front and rear sections together. When the toothless chordal portion of the gear segment 67 is reached, the segment 76 disengages and the front section 12 is pulled back, raising the central pivot connection and decreasing the distance between the front axle 21 and the rear axle 36 as is illustrated in FIG. 2. In FIG. 6, the gear segments 67 and 76 are just starting to engage to again drive the sections apart from the contracted position.

Power for the motor 48 is supplied by four batteries 84 through an on/off switch 85 by wiring (not shown). A spring contact clip 88 retains the batteries. In addition to providing power, the weight of the batteries 84 being over the rear axle 36 places the center of gravity of the toy 10 close to the rear axle 36, particularly when the front and rear sections are contracted as shown in FIG. 2. With the center of gravity over the rear axle 36 and forward movement of the rear wheel 38 obstructed by an irregularity or obstacle on the playing surface during contraction of the front and rear sections, the toy will tip or pivot, as shown in FIG. 7, in a clockwise direction about the rear wheel axis and do a "wheelie". The downwardly and rearwardly angled skid 43 is so positioned as to restrict the pivoting of the vehicle about the rear wheel axis to less than 90 degrees and conveniently to about 45 degrees.

In the "wheelie" position as illustrated in FIG. 7 the gear train will continue to be driven by the motor 48, causing the front section 12 to expand away from the rear section 14. As the sections are driven apart, the center of gravity is shifted forward tending to bring the toy back down into contact with the playing surface. Sometimes a repeated number of expansions and contractions is required before the toy comes back down from the "wheelie" position, resulting in a snapping-like action.

Mounted for swinging movement on the shaft 53 is a sound device 90 which has an open bottom resonating drum 91 and an upwardly projecting metal striker 92.

The sound device also includes a brace 94 having an aperture 95 that is of a large enough diameter to permit the sound device 90 to swing freely about the shaft 53. Either by the weight of sound device 90 itself or with the aid of counterweights 97, the sound device 90 is normally biased downwardly toward the play surface. A stop 99 extends between the side walls 28 and abutment of the bottom of the brace 94 against the stop keeps the sound device 90 from swinging down into contact with the playing surface 45. When the toy does a "wheelie" as shown in FIG. 7, the sound device swings clockwise around the shaft 53 bringing the striker 92 into contact with the irregularly spaced teeth of a ratchet wheel 100 that is mounted on the shaft 57 for rotation with the shaft to generate a clicking or staccato sound.

Toy 10 may be made in the form of a vehicle or be designed as a creature of some sort having a head such as 105. The head could be made with an articulated jaw to enhance the effect of the snapping-like action when the toy pivots upwardly as shown in FIG. 7. Provision may also be made for a rider such as the FIG. 110 shown in phantom in FIGS. 1 and 2 straddling the spaced apart walls 28 on the rear section 14. For this purpose a spring clip 111 may be secured to the front of the tail plate 31 to hold FIG. 110 about the waist. Stirrups 112 may be attached to either side of the side walls 28 to support the feet of the figure.

While a particular embodiment of the present invention has been shown and described with some alternatives, other changes and modifications will occur to those skilled in the art. It is intended in the following claims to cover all such changes and modifications as fall within the true spirit and scope of the present invention.

What is claimed as new and desired to be secured by Letters Patent is:

1. A self-propelled toy comprising:

a single rigid front section with opposed ends;

a single rigid rear section with opposed ends;

means mounting a wheel for free-wheeling rotation in a forward direction about an axis adjacent one end of each section;

means restricting the rotation of at least one of the wheels to the forward direction;

the axes adjacent the one end of each section being spaced apart and substantially parallel;

a pivot axle;

means connecting the other end of each section for pivotal movement about the same pivot axle;

the pivot axle being intermediate and substantially parallel to the wheel axes;

reciprocating pivotal movement of the sections about the pivot axle alternately increasing and decreasing the distance between the wheel axes causing the toy to move forwardly;

means biasing at least one section about the pivot axle and means driving at least one section about the pivot axle in opposition to the bias; and the drive means including periodically engaging gear segments mounted on each section with a motor mounted on one of the sections driving one of the gear segments.

2. The self-propelled toy of claim 1 in which the sections are biased together and driven apart.

3. The self-propelled toy of claim 2 in which the center of gravity of the toy is adjacent the rear wheel axis such that the entire toy will pivot about the rear wheel axis and lift the front wheel up off of a playing surface during biasing together of the sections.

4. The self-propelled toy of claim 1 in which the sections are biased apart and driven together.

5. The self-propelled toy of claim 1 in which:

the motor is an electric motor mounted on the rear section; and batteries supplying power to the motor are mounted on the rear section adjacent the rear wheel axis.

6. The self-propelled toy of claim 1 in which the center of gravity of the toy is adjacent the rear wheel axis such that the entire toy will pivot about the rear wheel axis when forward rotation of the rear wheel is obstructed.

7. The self-propelled toy of claim 6 including a sounding device carried by the toy and movable into engagement with the drive means to generate sound when the entire toy pivots about the rear wheel axis.

8. The self-propelled toy of claim 6 including a downwardly and rearwardly extending skid attached to the rear section to prevent the entire vehicle from pivoting more than 90 degrees about the rear wheel axis.

9. The self-propelled toy of claim 1 in which the means restricting rotation of at least one of the wheels to the forward direction comprises a ratchet rotating with the wheel and a pawl mounted on the section engaging the ratchet.

10. The self-propelled toy of claim 1 in which the means restricting rotation of at least one of the wheels to the forward direction comprises face ratchet rotating with the wheel engaging a stationary face ratchet mounted on the section.

11. The self-propelled toy of claim 10 in which the resiliency of the mounting means biases the face ratchet into engagement.

12. The self-propelled toy of claim 11 in which the wheel is mounted in a fork made of sufficiently resilient material to bias the face ratchet into engagement.

13. The self-propelled toy of claim 1 including means on one of the sections for securing a toy figure to the self-propelled toy.

14. A self-propelled toy comprising:

a front section with opposed ends;

a rear section with opposed ends;

means mounting a wheel for rotation about an axis adjacent one end of each section;

means restricting the rotation of the wheels to a forward direction;

the means restricting rotation of at least one of the wheels to the forward direction comprising a face ratchet rotating with the wheel engaging a stationary face ratchet mounted on the section;

the resiliency of the wheel biasing the face ratchet into engagement;

the axes adjacent the one end of each section being spaced apart and substantially parallel;

means connecting the other end of each section for pivotal movement about a pivot axis;

the pivot axis being intermediate and substantially parallel to the wheel axes;

reciprocating pivotal movement of the sections about the pivot axis alternately increasing and decreasing the distance between the wheel axes;

increasing the distance between the wheel axes causing the front wheel to rotate in a forward direction while the rear wheel remains stationary and decreasing the distance between the wheel axes causing the front wheel to remain stationary while the rear wheel rotates in the forward direction;

means biasing at least one section about the pivot axis and means driving at least the one section about the pivot axis in opposition to the bias; and the drive means including periodically engaging gear segments mounted on each section with a motor mounted on one of the sections driving one of the gear segments.

15. The self-propelled toy of claim 14 in which the wheel is a hollow, air filled, thin walled shell made of elastic material.

16. The self-propelled toy of claim 14 in which the sections are pivotally connected to each other about a single pivot axis.

17. The self-propelled toy of claim 14 in which:

the motor is an electric motor mounted on the rear section; and batteries supplying power to the motor are mounted on the rear section adjacent the rear wheel axis.

18. The self-propelled toy of claim 14 in which the center of gravity of the toy is adjacent the rear wheel axis such that the entire toy will pivot about the rear wheel axis when forward rotation of the rear wheel is obstructed.

19. The self-propelled toy of claim 18 including a sounding device carried by the toy and movable into engagement with the drive means to generate sound when the entire toy pivots about the rear wheel axis.

20. The self-propelled toy of claim 18 including a downwardly and rearwardly extending skid attached to the rear section to prevent the entire vehicle from pivoting more than 90 degrees about the rear wheel axis.

* * * * *